US005799990A

United States Patent [19]

Hardee

[11] Patent Number: 5,799,990

[45] Date of Patent: Sep. 1, 1998

[54] REVERSIBLE GATE LATCH WITH LOCKING MEANS

[76] Inventor: Carl B. Hardee, 2271 Hwy. 348, Loris, S.C. 29569

[21] Appl. No.: 837,996

[22] Filed: Apr. 15, 1997

[51] Int. Cl.[6] ..... E05C 3/04

[52] U.S. Cl. ..... 292/238; 292/205; 292/208; 292/284; 292/244

[58] Field of Search ..... 292/205, 207, 292/208, 67, 238, 244, DIG. 32, 148, 282, 283, 284, 150, 104, 106, 136

[56] References Cited

U.S. PATENT DOCUMENTS

| | | | |
|---|---|---|---|
| 284,336 | 9/1883 | Scranton | 292/136 |
| 577,818 | 2/1897 | Cronk | 292/136 |
| 810,683 | 1/1906 | Stark | 292/282 |
| 866,543 | 9/1907 | Walsh | 292/207 |
| 1,015,338 | 1/1912 | Peel | 292/205 |
| 1,326,554 | 12/1919 | Watson | 292/205 |
| 1,489,648 | 4/1924 | Schmidt | 292/284 |
| 1,658,762 | 2/1928 | Dickerson | 292/284 |
| 2,794,663 | 6/1957 | Grodt et al. | 292/67 |
| 3,907,344 | 9/1975 | Newlon et al. | 292/244 |
| 5,147,331 | 9/1992 | Rust | 292/238 |
| 5,511,835 | 4/1996 | Hardee | 292/205 |

*Primary Examiner*—Darnell M. Boucher
*Attorney, Agent, or Firm*—W. Alex Dallis, Jr.

[57] ABSTRACT

A reversible gate and door latch having a striker bar attached to a grip handle and a rear handle. The gate and door latch is locked in a closed position behind a pronged keeper by immobilizing a security plate that slides vertically in relation to the pivoting action of the striker bar. The security plate is held in place by the striker bar, which passes through it, and slides vertically through a upper and lower horizontal stirrup. The slidable security plate is immobilized by placing a padlock or security pin in a security plate aperture. A striker handle is attached to the striker bar in a parallel fashion to allow for facile griping and pivoting of the striker bar by the user. A rear handle secured to the opposite side of the gate or door allows for operation of the latch from opposite the locking side.

7 Claims, 3 Drawing Sheets

REVERSIBLE GATE LATCH WITH LOCKING MEANS

BACKGROUND OF THE INVENTION

1. Field of the Invention

The present invention relates to the field of gate and door latches and, more particularly, to a reversible gate and door latch secured by means of a padlock.

2. Description of the Related Art

The art of latches used for gates and doors is well known. Although a large number of patents have been granted for a variety of gate and door latches, most of these latches incorporate the use of either a sliding action and/or pivoting action to open or close the latching lever mechanism. Latches that use a padlock as a means for locking the latch in position include U.S. Pat. No. 2,794,663 to Grodt et al. having a slidable and pivotable bar including an aperture through which a padlock is inserted. U.S. Pat. No. 3,907,344 to Newton et al. describes a pivoting latch having apertures through which the padlock is secured. U.S. Pat. No. 5,511,835 to Hardee discloses a gate latch with multiple locking means. A padlock or pin locking means may be used to secure the keeper end of the striker or the slidable handle portion of the striker.

The present invention is a reversible gate and door latch that operates by means of a pivoting action having a striker bar attached to a grip handle. A security plate rests in a perpendicular fashion to the striker bar and is vertically slidable with the corresponding pivoting action of the striker bar. The security plate is held in place by the striker bar, which passes through the security plate. A striker handle is attached to the striker bar in a parallel fashion to allow for facile griping and pivoting of the striker bar by the user. A rear handle secured to the opposite side of the gate or door allows for operation of the latch from opposite the locking side. The latch may be locked in a closed position by securing the slidable security plate in place with a padlock or pin locking means.

SUMMARY OF THE INVENTION

It is therefore an objective of this invention to provide a gate and door latch having a vertically slidable security plate capable of locking the gate and door latch in a closed position by means of a padlock or security pin.

It is further an objective of this invention to provide a gate and door latch having a facile griping means for pivoting the latch striker bar into an open or closed position.

It is still further an objective of this invention to provide a gate and door latch that is reversible as necessary to accommodate the desired positioning of both keeper mount and striker base mount.

These as well as other objectives are accomplished by a reversible gate and door latch having a striker bar attached to a grip handle. A security plate slides vertically in relation to the striker bar and corresponds to the pivoting action of the striker bar. The security plate is held in place by the striker bar, which passes through it, and slides vertically through a upper and lower horizontal stirrup. A striker handle is attached to the striker bar in a parallel fashion to allow for facile griping and pivoting of the striker bar by the user. A rear handle secured to the opposite side of the gate or door allows for operation of the latch from opposite the locking side. The latch may be locked in a closed position by securing the slidable security plate in place with a padlock or pin locking means.

BRIEF DESCRIPTION OF THE DRAWINGS

A preferred embodiment of the present invention is described herein with reference to the drawings wherein.

DETAILED DESCRIPTION OF THE PREFERRED EMBODIMENT

Figure 1:
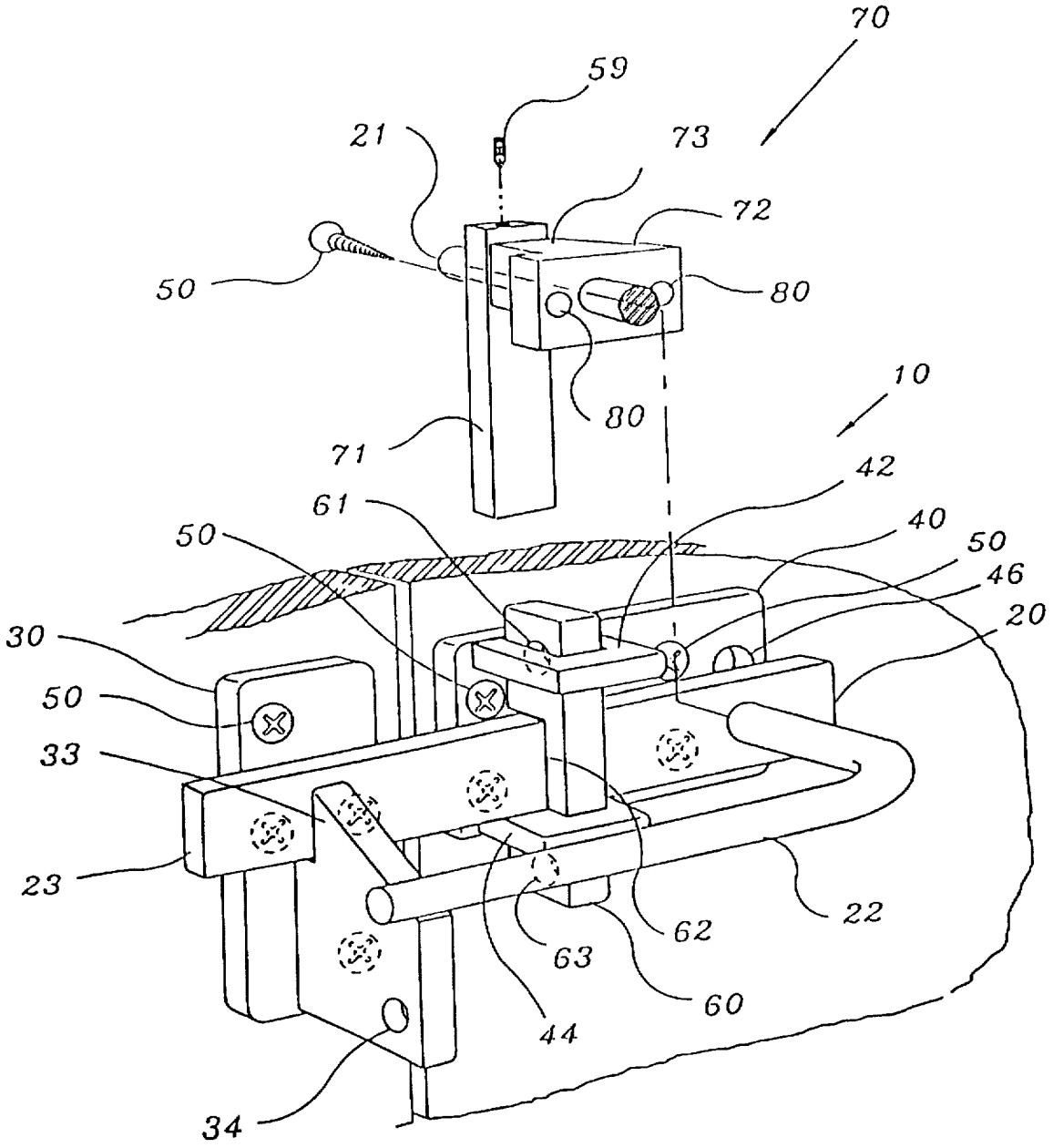
FIG. 1 of the drawings is a perspective front view of the gate and door latch and rear handle showing the latch in the closed position.

Referring to the drawings by numerals of reference, there is shown in FIGS. 1, 2, 3 and 3*a* the gate and door latch (10) having a striker bar (20) controlled by a striker handle (22) in front and a rear handle (70) located on the opposite side of the door or gate as the gate and door latch (10). The gate and door latch (10) latches into a closed position by means of a pronged keeper (33). The gate and door latch (10) may be secured in a locked position by means of a slidable security plate (60).

Referring to FIG. 1, the gate and door latch (10) including a rear handle (70) is shown in the closed position. The gate and door latch (10) is fixed to a door or gate by means of a base mount (40) and a keeper mount (30) fixed to a stationary post or wall. The keeper mount (30) is secured by permanent wood screws (50) screwed into the stationary wall or post. A lock rest aperture (34) located near the bottom end of the pronged keeper (33) is provided for resting a padlock or similar locking mechanism on the pronged keeper (33) when the gate and door latch (10) is not locked. Similarly, the base mount (40) of the gate and door latch (10) is secured to the door or gate by means of woods screws (50). When the gate and door latch (10) is in the closed position as depicted in FIG. 1, the striker latch end (23) of the striker bar (20) latches behind the pronged keeper (33) preventing the opening of the gate or door. A striker handle (22) is attached to the rear portion of the striker bar (20) providing an easy means for opening and closing of the gate or door.

Continuing to refer to FIG. 1, the rear handle (70) is shown connected directly to the striker handle (22). The rear handle (70) comprises a rear grip member (71), a rear handle mount (72) and a rear handle extension (73). The rear grip member (71) communicates with the striker handle (22) via the pivot rod (21) which is rotationally fixed to the rear grip member (71) by means of a set screw (59).

A unique feature of the gate and door latch (10) is the slidable security plate (60) as shown in FIG. 1. The striker bar (20) passes through the security plate slot (62) of the slidable security plate (60). The slidable security plate (60) moves vertically with corresponding up and down movement of the striker bar (20) caused by pivoting action of the striker handle (22) or rear grip member (71) of the rear handle (70). The vertical movement of the slidable security plate (60) is guided by a upper stirrup (42) and a lower stirrup (44) which prevent any lateral movement of the slidable security plate (60). In the closed position, the striker bar (20) is held in a locked position by means of placing a padlock or security pin through a lower security plate aperture (63). With a padlock or security pin in place, the striker bar (20) is prevented from pivoting and unlatching the striker latch end (23) from the pronged keeper (33).

Figure 2:
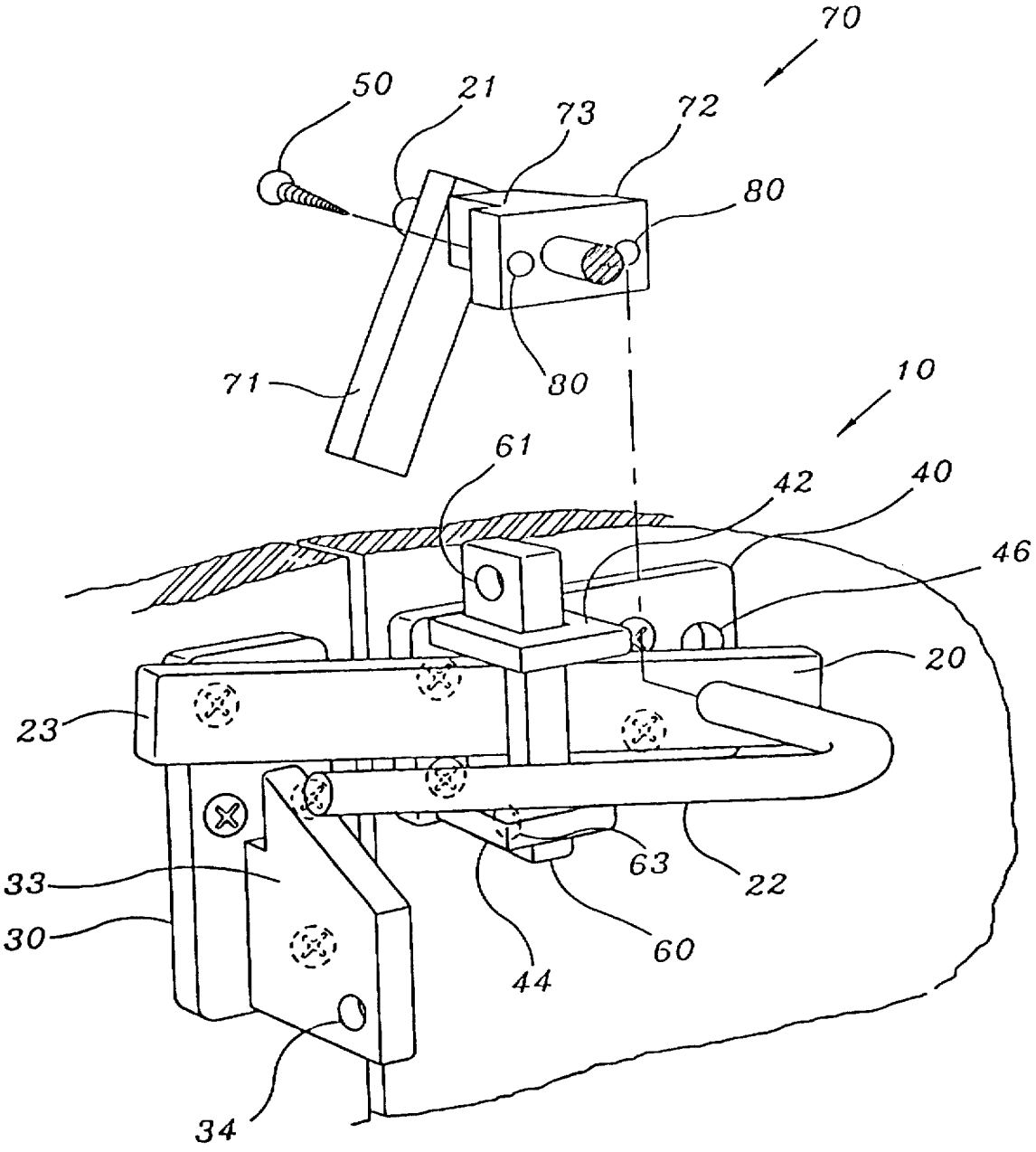
FIG. 2 of the drawings is a perspective front view of the gate and door latch and rear handle showing the latch in the open position.

Referring to FIG. 2, the gate and door latch (10) and rear handle (70) are shown in the open position. Without a padlock or security pin place in the lower security plate aperture (63) to interfere the vertical movement of the slidable security plate (60), the gate and door latch (10) may be pivoted into this open position thereby releasing the striker latch end (23) from the pronged keeper (33). The pivoting motion of the striker bar (20) is in concert with the partial rotation of the rear grip member (71) of the rear handle (70) which is rotationally fixed to the pivot rod (21). The rear handle (70) is secured to the back of the door or gate by means of wood screws (50) screwed through wood screw apertures (80) in a rear handle mount (72). The rear handle mount (72) also comprises a rear handle extension (73) which allows for the knuckle portions of the hand to comfortably ride between the door or gate and the rear grip member (71).

Figures 3, 3A:
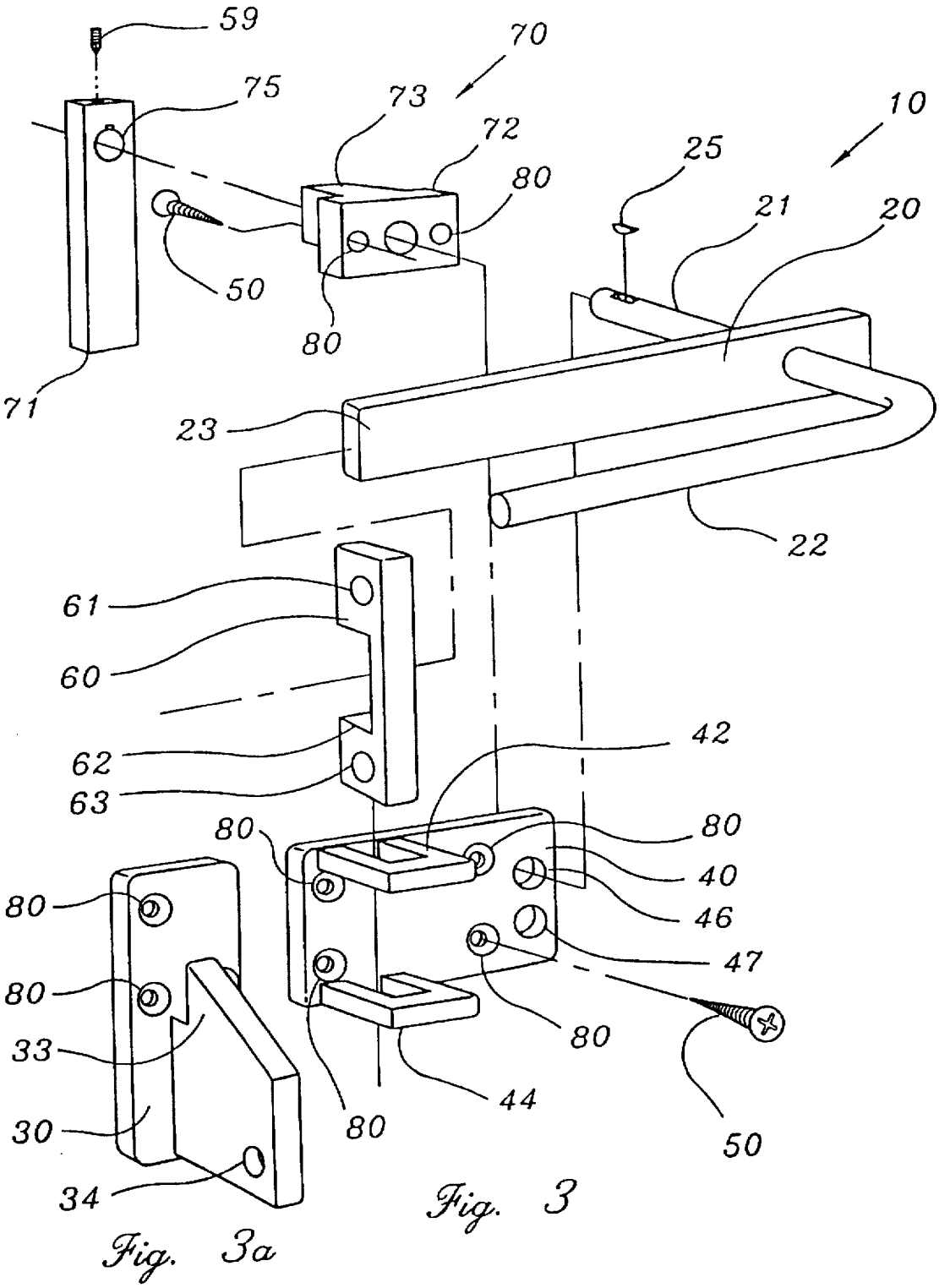
FIG. 3 of the drawings is a perspective view of the gate and door latch showing the various components of the latch in via a break-away view.
FIG. 3*a* of the drawings is a perspective view of the gate and door latch pronged keeper.

Referring to FIG. 3, a perspective view of all the components of the gate and door latch (10) and rear handle (70) are clearly shown. Additionally, the reversible nature of the gate and door latch (10) is appreciated as these components may be rotated 180 degrees allowing for placement of the gate and door latch (10) on the right or left hand side of a door or gate depending upon the need of the user. The base mount (40) of the gate and door latch (10) is clearly shown having four wood screw apertures (80) used to secure the base mount (40) to a door or gate. A lower pivot rod aperture (47) and a upper pivot rod aperture (46) are shown for the insertion of the pivot rod (21) through the gate or door. The lower pivot rod aperture (47) is used for gate and door latch (10) to be located on the left side of a door or gate (as shown in FIGS. 1 and 2), while the upper pivot rod aperture (46) would be used for a gate and door latch (10) to be located on the right side of a door or gate.

Continuing to refer to FIG. 3, the details of the slidable security plate (60) are revealed. The security plate slot (62) is shown slightly larger in perimeter dimensions than the outside perimeter of the striker latch end (23) in order to allow for the necessary pivoting motion actuated by turning the striker handle (22) of the gate and door latch (10) or rear grip member of the rear handle (70). Again, the reversibility features of the gate and door latch (10) can be appreciated by observing the function and placement of the lower security plate aperture (63) and the upper security plate aperture (61). When the gate and door latch (10) is placed on the left hand side of a door or gate, the lower security plate aperture (63) is used to lock the striker latch end (23) into the pronged keeper (33) by placing a padlock or security pin into the lower security plate aperture (63). The slidable security plate (60) is prevented from moving vertically by the lower stirrup (44) blocking the padlock or security pin placed in the lower security plate aperture.

Still referring to FIG. 3, the details of the rear handle (70) are depicted along with the striker bar (20) member of the gate and door latch (10). As described earlier, the striker handle (22) is rotationally fixed to the rear grip member (71) by means of insertion of the pivot rod (21) through the rear pivot rod aperture (75) wherein a set screw (59) secures into a woodruff key (25) located on the pivot rod (21). The rear handle mount (72) does not rotate with pivot action of both the rear grip member (71) or the striker handle (22). Instead, the rear handle mount (72) is mounted to the back of the door or gate by wood screws (50) that pass through wood screw apertures (80) located in the rear handle mount (72). The rear handle extension (73) is designed to provide sufficient clearance to the hand of the operator when rotating the rear grip member (71).

Referring to FIG. 3*a*, the pronged keeper (33) is depicted in a perspective view. As discussed earlier, the keeper mount (30) is secured to a stationary wall or post by means of wood screws inserted into the wood screw apertures (80) of the keeper mount (30). A lock rest aperture (34) is provided on the pronged keeper (33) for purposes of placing a padlock or security pin when the gate and door latch (10) is not intended to be locked.

That which is claimed is:

1. A reversible gate and door latch, comprising in combination:

a striker bar having a pivot end and a latch end, said striker bar being of an elongated, rectangular shape;

a striker handle having a handle portion and a pivot rod portion, said pivot rod portion extending at a right angle from said handle portion, said pivot rod portion passing through an orifice of said pivot end of said striker bar wherein said handle portion of said striker handle is aligned parallel and adjacent to said striker bar, said handle portion of said striker handle being separated from said striker bar by a distance of at least one inch, thus creating sufficient space to insert a human hand between said handle portion of said striker handle and said striker bar so that said handle portion of said striker handle may be grasped by an open palm of said human hand;

a slidable security plate having a security plate slot through which said striker bar passes, said slidable security plate being vertically slidable corresponding with a pivoting action of said striker bar when said striker bar is pivoted between an open and closed position;

a means for halting vertical motion of said slidable security plate causing said pivoting action of said striker bar to be halted;

a base plate secured to a door by means of a plurality of screws mounting said base plate to said door, said base plate further comprising a lower and upper pivot rod aperture, said pivot rod portion of said striker handle inserting through said lower pivot rod aperture of said base plate on said door;

a means for holding said slidable security plate in a vertical position, said means for holding comprising an upper stirrup and a lower stirrup each having a U-shaped opening whereby said slidable security plate slides vertically in an up and down fashion through said U-shaped openings of said upper and lower stirrups; and a keeper mount having a pronged keeper for holding said latch end of said striker bar whereby lateral movement of the striker bar is restricted.

2. The reversible gate and door latch according to claim 1 further comprising a rear handle secured to said door opposite said base mount and said keeper mount, said rear handle comprising:

a rear grip member having a rear pivot rod aperture through which said pivot rod is rotationally fixed;

a rear handle mount secured to said door, said rear handle mount having a rear handle mount aperture for insertion of said pivot rod, said rear handle mount aperture allowing rotational motion of said pivot rod; and a rear handle extension attached to said rear handle mount, said rear handle extension extending distance between said door and said rear grip member whereby said human hand may insert between said door and said rear grip member for facile grasping of said rear grip member to actuate rotation of said pivot rod.

3. The reversible gate and door latch according to claim 1 wherein said pivoting action of said striker bar is confined by placement of said striker bar between said upper stirrup and said lower stirrup.

4. The reversible gate and door latch according to claim 1 wherein said means for halting vertical motion of said slidable security plate causing said pivoting action of said striker bar to be halted comprises a lower and a upper security plate aperture, each aperture located at opposite ends of said slidable security plate with said security plate slot being between said upper and lower security plate apertures such that a padlock or pin may be inserted into said lower security plate aperture preventing upward motion of said slidable security plate by said padlock or pin butting against said lower stirrup when said pivoting action of said striker bar is induced.

5. The reversible gate and door latch according to claim 2 wherein said striker handle is tubular shaped and is secured to said grip member of said rear handle by means of insertion of a set screw through said grip member of said rear handle into a woodruff key inset in said pivot rod.

6. A reversible gate and door latch, comprising in combination:

a striker bar having a pivot end and a latch end, said striker bar being of an elongated, rectangular shape;

a striker handle being tubular shaped having a handle portion and a pivot rod portion, said pivot rod portion extending at a right angle from said handle portion, said pivot rod portion passing through an orifice of said pivot end of said striker bar wherein said handle portion of said striker handle is aligned parallel and adjacent to said striker bar, said handle portion of said striker handle being separated from said striker bar by a distance of at least one inch, thus creating sufficient space to insert a human hand between said handle portion of said striker handle and said striker bar so that said handle portion of said striker handle may be grasped by an open palm of said human hand;

a slidable security plate having a security plate slot through which said striker bar passes, said slidable security plate being vertically slidable corresponding with a pivoting action of said striker bar when said striker bar is pivoted between an open and closed position;

a means for halting vertical motion of said slidable security plate causing said pivoting action of said striker bar to be halted comprising a lower and a upper security plate aperture, each aperture located at opposite ends of said slidable security plate with said security plate slot being between said upper and lower security plate apertures such that a padlock or pin may be inserted into said lower security plate aperture preventing upward motion of said slidable security plate by said padlock or pin butting against said lower stirrup when said pivoting action of said striker bar is induced;

a base plate secured to a door by means of a plurality of screws mounting said base plate to said door, said base plate further comprising a lower and upper pivot rod aperture, said pivot rod portion of said striker handle inserting through said lower pivot rod aperture of said base plate on said door;

a means for holding said slidable security plate in a vertical position, said means for holding comprising an upper stirrup and a lower stirrup having a U-shaped opening whereby said slidable security plate slides vertically in an up and down fashion through said U-shaped openings of said upper and lower stirrups, said pivoting action of said striker bar being confined by placement of said striker bar between said upper stirrup and said lower stirrup;

a keeper mount having a pronged keeper for holding said latch end of said striker bar whereby lateral movement of the striker bar is restricted;

a rear handle secured to said door opposite said base mount and said keeper mount, said rear handle comprising:

a rear grip member having a rear pivot rod aperture through which said pivot rod is rotationally fixed;

a rear handle mount secured to said door, said rear handle mount having a rear handle mount aperture for insertion of said pivot rod, said rear handle mount aperture allowing rotational motion of said pivot rod; and a rear handle extension attached to said rear handle mount, said rear handle extension extending distance between said door and said rear grip member whereby said human hand may insert between said door and said rear grip member for facile grasping of said rear grip member to actuate rotation of said pivot rod.

7. The reversible gate and door latch according to claim 6 wherein said striker handle is secured to said grip member of said rear handle by means of insertion of a set screw through said grip member of said rear handle into a woodruff key inset in said pivot rod.

* * * * *